United States Patent [19]

Mendenhall

[11] 4,208,131

[45] Jun. 17, 1980

[54] ASPHALTIC CONCRETE PATCH MIXING AND HEATING APPARATUS AND METHOD

[76] Inventor: Robert L. Mendenhall, 1770 Industrial Rd., Las Vegas, Nev. 89102

[21] Appl. No.: 871,351

[22] Filed: Jan. 23, 1978

[51] Int. Cl.[2] ..... B28C 5/46

[52] U.S. Cl. ..... 366/7; 366/25; 366/38; 432/105

[58] Field of Search ..... 366/25, 24, 23, 22, 366/42, 54, 39, 30, 33, 36, 38, 7, 60, 62, 63, 147, 148, 144; 432/105, 106

[56] References Cited

U.S. PATENT DOCUMENTS

| | | | |
|---|---|---|---|
| 792,642 | 6/1905 | Williams | 432/105 |
| 1,578,021 | 3/1926 | Elze | 366/25 |
| 1,609,072 | 11/1926 | Elze | 366/25 |
| 1,767,746 | 6/1930 | Elze | 366/25 |
| 2,305,938 | 12/1942 | Turnbull | 366/25 |
| 2,455,531 | 12/1948 | Stroman | 432/105 |
| 3,674,242 | 7/1972 | Stewart | 366/23 |
| 4,039,171 | 8/1977 | Shearer | 366/25 |
| 4,075,710 | 2/1972 | Jakob | 366/25 |

*Primary Examiner*—Robert W. Jenkins
*Attorney, Agent, or Firm*—Seiler & Quirk

[57] ABSTRACT

An apparatus for heating and mixing an asphalt-aggregate composition comprises a drum rotatable about an axis, having a mixing and heating chamber with a restricted port at one end into which a flame and hot gases of combustion are directed and through which exhaust gases simultaneously pass to atmosphere, and a heating means comprising a burner nozzle for directing flame and the hot gases of combustion into the chamber at the restricted port. The nozzle is adjusted relative to the port whereby the volatiles from the asphalt are ignited and burned within the mixing chamber prior to being vented to the atmosphere from the restricted port. Composition may also be introduced and/or removed from the chamber through the restricted port.

25 Claims, 7 Drawing Figures

ASPHALTIC CONCRETE PATCH MIXING AND HEATING APPARATUS AND METHOD

BACKGROUND OF THE INVENTION

Patching asphaltic concrete surfaces has presented significant problems, particularly because of the seasonal unavailability of suitable patching compositions. A preferred patching composition for asphaltic concrete surfaces is a "hot-mix" comprising a heated asphalt-aggregate composition, normally at a temperature above about 200° F. Such a composition, because of the hot asphalt consistency, is semi-fluid, and easy to handle in filling a pot-hole or other cavity in the asphaltic concrete surface, and thereafter is readily worked, smoothed and compacted, to be compatible with the existing surface composition. A disadvantage of the "hot-mix" is that it is not generally available in the winter from hot-mix plants, and even when available, becomes significantly cooled as it is transported from the plant to the job site. Thus, a user must normally order a much greater amount of asphalt-aggregate patching composition than is actually required to accomplish the job, because the composition will cool and the exterior composition becoming hard and crusted by the time it arrives at the site at which it is to be used. Even then, the user must break away the hard outer crust composition, and recover the hotter, softer, and more readily workable and usable interior composition for filling the cavity. Usually the hard, cool remainder of the composition is discarded. Obviously, such a practice is wasteful, and economically undesirable.

As an alternative to the preferred hot-mix patching composition, and because that material is generally unavailable during cold weather or in the winter, patching is often accomplished utilizing an asphalt emulsion or cut-back material. Although such a composition remains somewhat semi-fluid and is workable at colder temperatures than the hot-mix material, it is not as compatible with the existing asphaltic concrete surfaces, generally has a poorer longevity, and thus must be replaced more frequently.

SUMMARY OF THE INVENTION

According to the present invention, a very practical, portable apparatus is provided for producing a hot-mix asphalt-aggregrate composition. The apparatus may be readily moved from place to place, so that composition may be mixed and heated to form a hot-mix at the job site, and immediately used. Thus, because of the apparatus, a method is provided for achieving a hot-mix asphalt-aggregate composition at the job site, for immediate use, regardless of cold temperature conditions, and the non-availability of commercial hot-mix materials. A specific advantageous feature of the apparatus is a restricted port open to atmosphere and contiguous with the heating and mixing chamber, into which flame and hot gases of combustion for heating the composition are introduced, and out of which port and simultaneously, exhaust gases from the flame and combusted asphalt hydrocarbon volatiles, are vented. The advantages of the apparatus as well as its characteristics and the use thereof will be evident from the following detailed description.

DETAILED DESCRIPTION OF THE INVENTION

Figure 1:
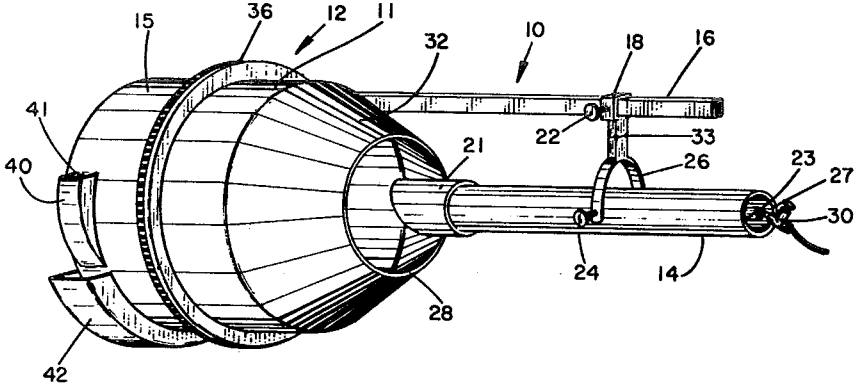
FIG. 1 is a perspective view of the apparatus.
Figure 2:
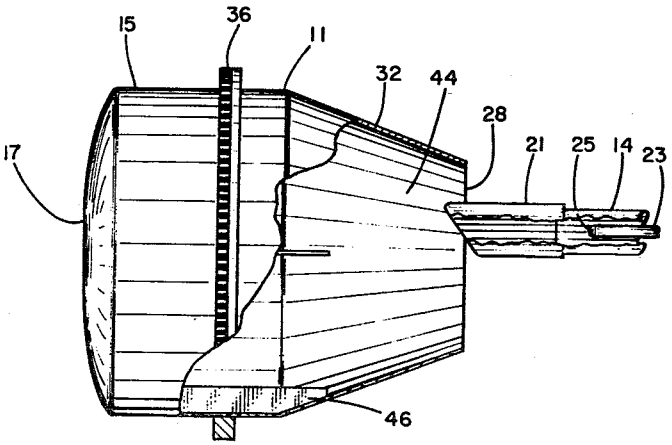
FIG. 2 is a side elevational view of the apparatus without a scoop feed and with a portion of the drum and burner nozzle cut away.

In FIGS. 1 and 2 there is shown the apparatus of the invention comprising a drum assembly 12 and burner assembly 10. The drum assembly includes a drum 11 which is hollow, and which drum may be substantially closed except for a restricted port 28 at the forward end. Flame and hot gases of combustion from the burner assembly for heating asphalt-aggregate composition are directed through the restricted port, and at the same time, the exhaust gases from the drum, are vented to the atmosphere through the same port. Asphalt-aggregate composition may also be introduced and/or removed through port 28. The characteristics of the drum are a preferably circularly shaped wall 15 extending forwardly from closed back wall 17, and interiorally of which wall is formed the major portion of the mixing chamber, and a downwardly tapered wall portion 32. This tapered wall is contiguous with wall portion 15, and gradually tapers therefrom to port 28. The port is preferably also circular, whereby the port diameter is smaller than the maximum chamber diameter defined within circular wall portion 15. Where the tapered wall portion 32 is of uniform taper between the larger circular wall portion 15 and port 28, it forms a frustoconical shaped tapered area 44. However, although tapered wall 32 may be advantageous in recovering composition from the drum, it is not a critical feature.

Figure 4:
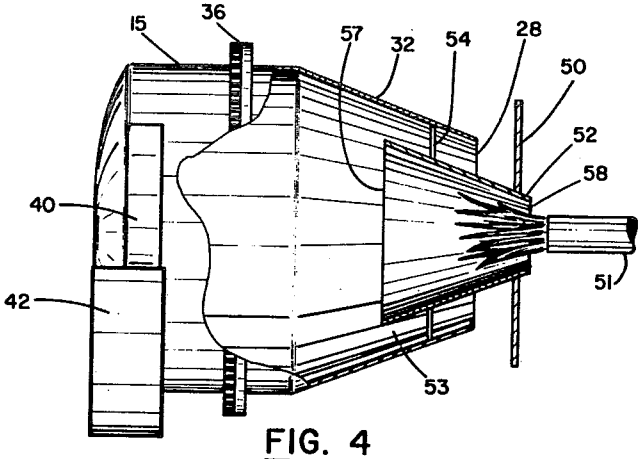
FIG. 4 is a side elevational view of a modified drum portion of the apparatus.
Figure 3:
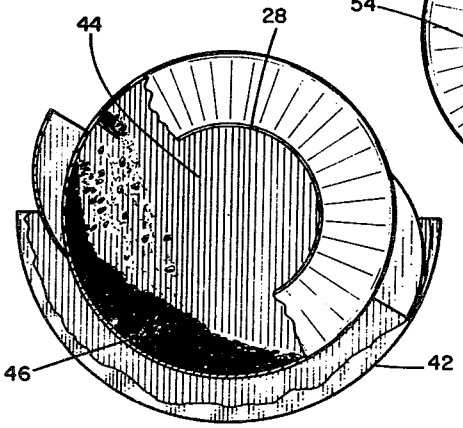
FIG. 3 is a front view of the drum portion of the apparatus, partially cut away to expose the interior.

Asphalt-aggregate composition heated and mixed within the drum may be introduced through port 28, often conveniently simply shoveled into the port. The apparatus of FIG. 2 will utilize such a means for feeding or supplying composition to the mixing and heating chamber. Optionally, composition may be introduced by incorporating one or more scoops 40, preferably secured adjacent or near the back or rear drum cover 17, opposite the forward restricted port 28, as shown in FIGS. 1, 3 and 4. Associated with such a scoop is an opening 41 in the drum wall 15, and a trough 42 into which asphalt-aggregate composition is placed. Accordingly, as the drum rotates, with the composition having been placed in the trough 42, the lip of scoop 40 will pick up the composition as it travels through the trough, and thereafter the composition will fall gravitationally through opening 41 into the interior of the drum. Because of the direction in which the scoop is secured on the drum as shown, and with the drum rotating clockwise, the composition will be introduced into the drum, but will not fall out, as is illustrated in FIG. 3. Other alternative means may also be employed to introduce the asphalt-aggregate composition into the drum such as a chute member secured on a stationary back plate. With such alternative feed means for the drum incorporating openings in the drum assembly other than the forward restricted port, the opening size should be limited and positioned so that escape of exhaust and volatile hydrocarbon gase from within the drum are minimized.

The drum is rotatably driven preferably about an axis extending substantially along the center of the drum, the axis also extending through the center of restricted port 28 and the back plate of the drum. Means for rotating the drum includes an anular collar 36 having suitable gear teeth or the like for meshing with gears of associated drive means, well known to those skilled in the art. Alternatively, belt, trunnion, chain link drive or other equivalent means for rotating the drum may be used. As the drum is rotated in a clockwise direction as the drawings are viewed, asphalt-aggregate composition within the drum is carried along the drum interior upwardly, until it gravitationaly tumbles or cascades in a manner illustrated specifically in FIG. 3. This lifting and tumbling of the composition also continually exposes the composition particles to flame and hot gases of combustion introduced into the drum through the restricted port, whereby the composition becomes progressively heated. Flights or blades 46 may be incorporated conveniently along the interior drum surface to assist in elevating the composition as the drum is rotated. Other means incorporated within the drum may also be used to achieve this purpose.

The drum also preferably includes means for varying the angle or pitch of the drum axis relative to horizontal. Normally, the drum will be secured or mounted on a supporting base or frame assembly, preferably one having wheels to assist in easily moving or transporting the apparatus, whereby the drum is pivotally mounted on the frame or base assembly. Thus, a wheel, lever, or the like may be associated with the drum for tilting it in a manner well known for cement-type mixers. Normally, when the composition is being initially heated in the drum, the drum will be positioned so that the axis of rotation is substantially horizontal, or even with restricted port 28 tilted upwardly somewhat to prevent composition from being dumped from the port as it is being heated. However, once desirable composition temperatures are achieved, for example, above about 150° F., preferably above about 200° F., and more preferably above about 225° F., the drum may then be tilted so that some of the composition is recovered through the restricted port, all at once, or in a continuous manner.

It may be especially desirable to utilitize the apparatus in a continuous heating process whereby cold asphalt-aggregate composition particles are introduced into the rear drum end incorporating the scoop and trough means shown or other equivalent means, and as this composition becomes gradually heated, it is directed forwardly toward the restricted port for recovery. In any event, an operator will be able to readily observe the condition of the material being processed in the apparatus, and when it appears to be in a state in which the asphalt is quite fluid, it may be recovered for the patching or other use. However, if the composition has not yet achieved the desired temperature, it simply can be shoveled back in to the port 28 for further heating as desired.

The heating means for the apparatus comprises primarily a burner, such as a pipe 23, through which a combustible gas or the like is discharged. Conveniently, natural gas, propane or butane is directed to the pipe, the supply for which may be adjusted by valve 30. In the apparatus shown, a sleeve 14 extends over the pipe 23 in order that atmospheric air to support combustion can be entrained to the burner nozzle 25 through sleeve opening 27, which is a sufficient distance away from the nozzle, flame shield 21, and drum port 28, so that atmospheric oxygen concentrations are suitably high. However, openings around the sleeve 14, again, preferably away from the nozzle 25 and flame projected therefrom, may be used. If desirable, a flame shield may be secured at the forward end of sleeve 14, this shield preferably being of increased size relative to the sleeve so as to act as a Venturi-type chamber for the flame as it is directed forwardly from burner nozzle 25. Such a feature may simply give better directional characteristics to the flame and hot gases of combustion in order to more accurately introduce them into the rotating drum restricted port 28. Further, such a flame shield also provides a means for shielding the flame from the effects of air currents or wind passing near the flame and the drum port, which would otherwise deflect the flame from the desired direction. Other equivalent means for achieving this purpose may also be used within the purview of the invention.

A most important feature of the heating or burner assembly comprises means for moving the burner nozzle or flame directing shield relative to the drum port 28. For this purpose, an arm or boom 16 is incorporated for supporting a movable bracket or slide 18 from which extends a support hanger 26 attached to sleeve 14. Bracket 18 incorporates a thumb screw 22 for tightening the bracket at selected locations or positions along boom 16. Similarly, support 26 may incorporate a thumb screw 24 for securing sleeve 14 at any desired tilt or angle relative to horizontal, it being understood that the sleeve is pivotally supported on support 26 with a hinge pin or the like extending from both support ends into opposite sides of the sleeve. Further, the apparatus may include a swivel joint 33 so that the sleeve may be angled relative to boom 16. Any of these components may be modified or similar or equivalent components substituted therefor to achieve the function and result of being able to vary and adjust the position of burner nozzle and/or flame shield 21, from which the flame and hot gases of combustion are directed, into the rotating drum, relative to port 28. Accordingly, rather than incorporating a boom 16, a telescoping or similarly adjustable extension arm may be used so that flame shield 21 can be moved further into the drum port or back away from it. In addition, any other equivalent and suitable means for lowering or raising the flame shield as well as the angle at which it is directed toward or into port 28 may be used.

The operator may have on hand a suitable amount of cold asphalt-aggregate composition, which can be directly introduced into the drum, whether by shoveling or by otherwise placing it in to the restricted port 28, or introducing it by the scoop or other means disclosed hereinabove. If such a particulate composition is not on hand, the operator may break up a portion of the surrounding asphaltic concrete surface to be treated, as well as to obtain chunks of asphaltic concete from any other source, in the amount necessary to fill the cavity. These chunks may then be broken up by any suitable means to achieve the desired particle size ranges. Thereafter, the composition particles are simply loaded into the drum, and heat is applied from the burner through port 28. Although particle size uniformity is not necessary in using the appratus described, rather large chunks of composition should be broken up so that they can be fed into the optional scoops, and because they are not as evenly heated as smaller and more uniform particles.

As the asphalt-aggregate composition is gradually heated from ambient temperatures within the rotating drum, as the composition is ultimately picked up and carried along the side of the drum and cascades through the hot gases of combustion, hydrocarbon volatiles are released from the asphalt, which volatiles are in the form of noxious combustible fumes, normally visible, especially if the hydrocarbons were to be directly released to the atmosphere from the drum. It is to the avoidance of such pollution that the apparatus and method of the invention is particularly directed. Because of restricted port 28, the hydrocarbon volatiles and smoke given off by the hot asphalt within the drum, remain in the mixing chamber rather than being immediately vented into the atmosphere, as they normally would without the restricted port. Moreover, as the flame and hot gases of combustion are directed into the drum interior through the restricted drum port, the hydrocarbon volatiles are ignited, thereby being more fully combusted or oxidized to carbon dioxide and water. Such combustion often produces a visible blue flame or glow within the heating chamber. These products of combustion are much more environmentally acceptable for being vented to the atmosphere as compared to the smoke or other visible non-combusted volatile hydrocarbon materials given off by the heated asphalt. The exhaust gases from within the drum, which include the combined exhaust from the gases of combustion from the burner, and the burned asphalt hydrocarbon volatiles, are also vented through the restricted port to the atmosphere, simultaneously with the introduction of the hot burner gases into the drum.

In achieving combustion of the hydrocarbons volatilized from the heated asphalt within the drum, it is important that the position of the nozzle 25, or flame shield 21, if used, be adjusted relative to restricted drum port 28 to optimize this internal drum combustion and at the same time reduction of smoke and uncombusted hydrocarbon volatiles vented into the atmosphere. Where the flame shield or burner nozzle are placed too far into the drum interior there will occur a "blowback" effect of forcing these asphalt generated volatiles out of the drum port prematurely, or prior to full combustion. On the other hand, if the nozzle or shield are backed too far from the restricted drum port, the burner gases may be too cool by the time they reach the drum interior to fully ignite the asphalt hydrocarbon volatiles. Further, such a significant distance between the flame nozzle and drum port will also result in flame deflection and concomitant loss of process efficiency, where windy conditions exist. Thus, an operator will make adjustment of the burner nozzle or flame shield relative to the drum port 28 to take the greatest advantage of the process, and whereby the exhaust gases being vented to atmosphere may pass between the incoming flame and hot burner gases and the restricted port lip.

Figure 5:
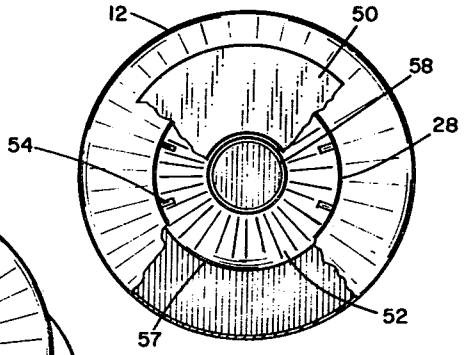
FIG. 5 is a front view of the modified drum embodiment shown in FIG. 4, and partially cut away.

In FIGS. 4 and 5 there is illustrated another embodiment of the apparatus incorporating a restricted funnel 52. The funnel preferably has a frusto-conical shape so that it is gradually tapered between opening 57, within the drum interior, and more restricted or smaller opening 58, exterior of drum port 28. The funnel may be secured to the drum by support arms 54, which are attached to both the funnel and the drum, or by any other equivalent suitable means. It is important that the funnel is separated from the drum interior thereby leaving a passageway or space 53 entirely around the funnel for recovering composition from within the drum. The purpose of the funnel is to provide even a more pronounced restricted means for directing the flame and/or hot gases of combustion from burner nozzle 51 into the drum interior, and to avoid or minimize the effects of wind currents from entering the drum and blowing unburned asphalt volatiles through the drum port prior to combustion. The funnel also includes a plate 50, preferably mounted at a right angle to the axis of drum rotation, and parallel with a plane extending along port 28, which plate acts as a shield to deflect atmospheric wind currents. The funnel will direct the flame and hot gases of combustion into the drum interior for burning the hydrocarbon volatiles, which combustion products will then readily exit through the passageway 53 and are vented into the atmosphere through drum port 28. Moreover, to recover heated composition from the drum, the drum is simply tilted sufficiently so that the composition particles can flow to the passageway 53 and pass through port 28 for recovery and use.

Figure 6:
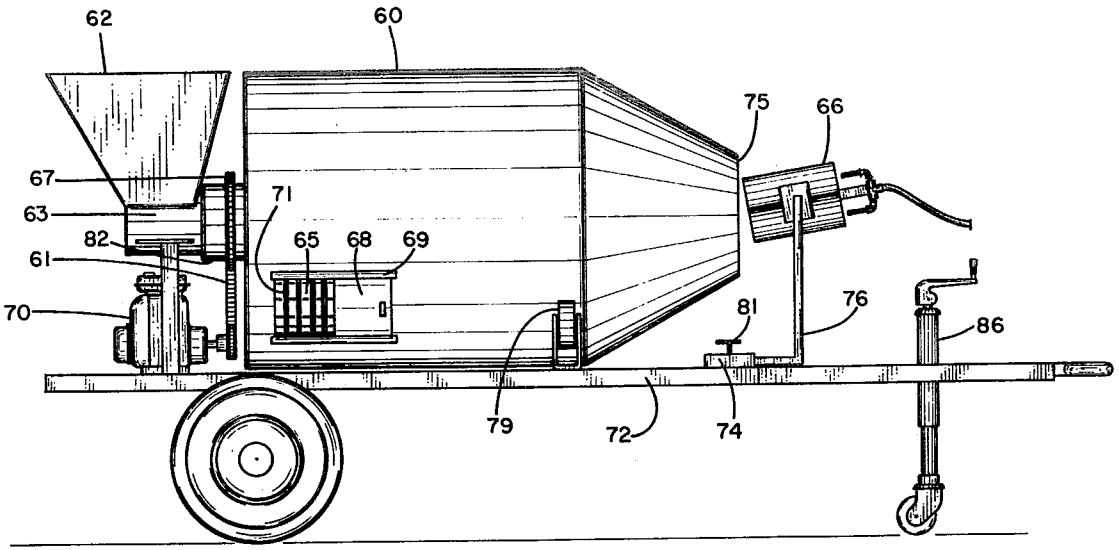
FIG. 6 is a side elevational view of another embodiment of the apparatus.
Figure 7:
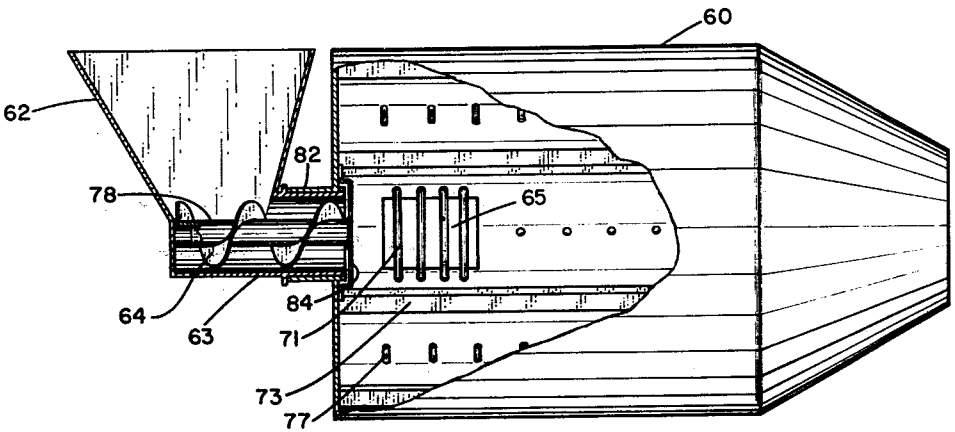
FIG. 7 is an enlarged and partially cut away view of a portion of the apparatus of FIG. 6.

In FIGS. 6 and 7 there is illustrated still another embodiment of an apparatus according to the invention which optionally includes a hopper 62 for introducing asphalt-aggregate composition into drum 60. Hopper 62 is simply a funnel-like member into which composition is loaded. The hopper has a port 78 near or at the bottom and communicates with tube 63 which also communicates with the interior of the drum. To assist in more uniformly introducing composition into the drum, a feed screw 64 turns or rotates within tube 63 and advances composition from the hopper into the drum. Such a screw will conveniently be driven as drum 60 rotates, and may be secured or attached to the drum for being commonly driven. As shown, feed screw 64 is attached to bracket 84 which is welded to the back of the drum.

Motor 70 is mounted on frame 72. The motor drives a chain belt 61 through suitable gears and drive shafts, and which chain then drives sprocket 67. The sprocket is mounted on sleeve 82 which is integral with, or secured on the back drum wall. Bearings or other friction reducing means such as low friction coatings may be used between the adjacent rotating sleeve 82 and stationary tube 63 surfaces. A support roller 79 is mounted on each side of the trailer frame 72 for assisting in supporting the drum as it rotates. Wheels on the frame are also shown whereby the apparatus may be easily trailered. Although composition may be recovered from the forward drum end through restricted port 75, as in the previously described apparatus, alternative recovery means may be used. For this purpose, a recovery port 65 may be cut on the side of the drum, at one or more convenient locations, and through which port the interior of the drum is exposed. Preferably, a door 68 is also provided for selectively covering or closing recovery port 65. The cover is conveniently slideably mounted on track 69 so that an operator can simply push the cover to selectively open or close recovery port 65, as desired. Also preferably associated with the port is a grate 71, conveniently mounted over the port and secured to the interior drum surface. The grate bars are separated by spaces which determine the size of particles recovered through the port. In this manner, when the recovery port is open or exposed, large chunks of composition will be prevented from falling through the port because of the bars, or other restrictive means, such as screen or the like.

Also optionally provided in the apparatus are fins 73 and studs 77 which project upwardly somewhat from the interior drum surface in order to assist in holding off rather large chunks or pieces of asphaltic concrete from the drum surface. As larger particles become heated and the asphalt softened, they will begin to sag and crumble to form smaller particles. Other means may be used to prevent the large particles, or chunks from lying directly against the drum interior surface while the asphalt is being initially heated. When composition is introduced into the drum, especially where there is a substantial quantity of smaller particles or fines, it will be normally desired to close recovery port 65, whereby composition remains within the drum until it has become heated to the desired temperature. Thereafter, as desired product temperatures are achieved, the recovery port cover may be opened, and product recovered continuously, or in a batch manner.

A burner assembly 66 is conveniently mounted on a stand 76, having a lower leg slideably extended into sleeve 74, and secured on frame 72. A handle 81, threadedly engaging the sleeve may be used to tighten and secure the burner at the desired proximity with port 75 in a manner as previously described. Accordingly, the burner can be moved closer or away from the port in order to achieve the desired burning of hydrocarbons within drum 60, whereby venting of these hydrocarbons into the atmosphere through port 75, prior to combustion, is avoided. A jack stand 86 may also be incorporated for supporting the frame, raising or lowering the forward drum end for leveling and/or product recovery purposes, as well as to assist in mounting the frame for towing means. Otherwise, the apparatus functions similarly to that previously described.

Such an apparatus of the embodiment of FIGS. 6 and 7 is particularly advantageous in processing composition having significant variation of particle sizes. For example, where the asphaltic concrete to be treated is a mixture of rather large chunks, as well as smaller particles and fines, as might normally be achieved by breaking up pavement with a jack hammer, or the like, at the job site, all of the material may simply be fed into restricted port 75, and recovered, after heating, through recovery port 65. Thus, where composition size ranges are significantly varied, especially with the presence of larger chunks, drum feeding through hopper 62 is not used. Such a feature obviates the necessity of further crushing or breaking up the composition introduced into the drum, with the upper limit of composition sizes being limited only by practical handling capabilities and the restricted port opening. Alternatively, where the recycled asphalt-aggregate composition is of a more uniform particle size range, for example, all particles passign a 2-3 inch mesh sieve, all of the composition is introduced into the drum via hopper 62, and recovery port 65 closed, and product recovered through restricted port 75. This may be accomplished without even tilting the drum. Thus, the apparatus shown provides alternatives in processing a variety of materials having different particle size characteristics. Other modifications of the apparatus within the purview of the invention herein will be evident to those skilled in the art, as will the advantages of the apparatus and the process as disclosed herein.

I claim:

1. Apparatus for heating and mixing asphalt-aggregate composition comprising a drum, rotatable about an axis, having a mixing chamber with a single enlarged open port, into which a flame and hot gases of combustion are directed and out of which exhaust gases are concurrently vented, and heating means having a burner nozzle for directing a flame and hot gases of combustion into the approximate center of said port and substantially parallel with the drum axis of rotation;

means for moving said burner nozzle along the axis of drum rotation relative to said drum, and a closable recovery port on the side of said drum and communicating with the interior thereof through which heated composition may be recovered.

2. Apparatus of claim 1 wherein said mixing chamber and said open port are circularly shaped, said chamber having a maximum diameter greater than the diameter of said port.

3. Apparatus of claim 2 including a funnel secured within said chamber and extending outwardly through said open port, said funnel being spaced from the drum interior and port to provide a passageway for recovery of composition, and tapered downwardly from a first opening interior of said port, and a second opening exterior of said port.

4. Apparatus of claim 3 including a plate secured to said funnel exteriorly of said port.

5. Apparatus of claim 4 wherein said funnel is axially mounted relative to the rotational axis of said drum and wherein said plate lies along a plane normal to said axis.

6. Apparatus of claim 3 wherein said first and second passageways are circular and said second opening has a diameter smaller than the diameter of said port.

7. A method of heating asphalt-aggregate composition comprising mixing said composition in an apparatus of claim 3 while rotating said drum, and simultaneously directing flame and hot gases of combustion into said drum through said first funnel opening, and recovering heated composition through said open port.

8. Apparatus of claim 1 including means adjacent a drum end opposite said open port for introducing composition into the chamber.

9. Apparatus of claim 1 including a cover for said recovery port.

10. Apparatus of claim 9 including restriction means cooperating with said recovery port for limiting the size of composition particles recovered through said recovery port.

11. A method of heating asphalt-aggregate composition comprising mixing said composition in a rotating drum while directing flame and hot gases of combustion into said drum whereby the composition is directly exposed to said hot gases, said flame and hot gases being directed into said drum through a port open to atmosphere, burning hydrocarbon volatiles from said composition in said drum and concurrently venting the burned hydrocarbon volatiles to atmosphere through said port and substantially preventing gases in said drum from being vented to atmosphere except through said port.

12. A method of heating asphalt-aggregate composition comprising mixing said composition in a rotatable drum having a mixing chamber with a restricted port open to atmosphere while rotating said drum and simultaneously heating said composition by directing flame and hot gases of combustion into said drum through said restricted port, whereby the composition is directly exposed to said hot gases and hydrocarbon volatiles from the composition are burned in said drum, and concurrently venting the burned hydrocarbons to atmosphere substantially only through said port.

13. The method of claim 12 including recovering heated composition through said restricted port.

14. The method of claim 13 wherein composition is introduced into said drum through said restricted port.

15. A method of claim 12 including moving said flame closer or further from said port for preventing visible unburned hydrocarbons from being vented through said port to atmosphere.

16. In a process for treating an asphalt-aggregate composition in a rotating drum by directly exposing the composition to hot gases of combustion, the improvement comprising directing said hot gases into said drum through a restricted drum port, whereby said composition is heated and asphalt hydrocarbon volatiles are combusted, and venting exhaust and combustion gases out of said drum to atmosphere substantially only through said restricted port at the same time that said hot gases of combustion are directed into said drum through said port.

17. The process of claim 16 including introducing said composition through said restricted port.

18. The process of claim 16 including recovering said heated composition through said restricted port.

19. Apparatus for heating and mixing asphalt-aggregate composition comprising a rotatable drum having a mixing chamber therein, a restricted port at a first end therein open to atmosphere, into which hot gases of combustion are directed and out of which exhaust gases are concurrently vented, a burner for directing hot gases of combustion into said chamber through said restricted port, a closable recovery port adjacent a second drum end, through which heated composition may be recovered, and cover means for selectively opening and closing said recovery port, and means for introducing composition at the second drum end.

20. Apparatus of claim 19 wherein said mixing chamber and restricted port are circularly shaped, said chamber having a maximum diameter greater than the diameter of said enlarged port.

21. A method of heating and mixing an asphalt-aggregate composition in an apparatus of claim 19 comprising rotating the drum while directing hot gases of combustion into the mixing chamber through the restricted port and concurrently venting exhaust gases to atmosphere through the restricted port while substantially preventing gases in said drum from being vented to atmosphere except through the restricted port, and after the composition has become heated, opening the recovery port and recovering heated composition therethrough.

22. A method of heating asphalt-aggregate composition comprising mixing said composition in a rotatable drum having a mixing chamber with a restricted port open to atmosphere while rotating said drum and simultaneously directing flame and hot gases of combustion into said drum through said restricted port, whereby the composition is directly exposed to said hot gases and hydrocarbon volatiles from the composition are burned in said drum prior to being vented to atmosphere through said restricted port, and recovering heated composition through said restricted port.

23. In a process for treating an asphalt-aggregate composition in a rotating drum by exposing the composition to hot gases of combustion, the improvement comprising introducing said composition into said drum through a restricted drum port, directing said hot gases into said drum through said restricted port whereby said composition is heated and asphalt hydrocarbon volatiles are combusted, and simultaneously venting exhaust and combustion gases from said drum to atmosphere through said restricted port.

24. In a process for treating an asphalt-aggregate composition in a rotating drum by exposing the composition to hot gases of combustion, the improvement comprising directing said hot gases into said drum through a restricted drum port, whereby said composition is heated and asphalt hydrocarbon volatiles are combusted, simultaneously venting exhaust and combustion gases from said drum to atmosphere through said restricted port, and recovering said heated composition through said restricted port.

25. A method of heating asphalt-aggregate composition comprising mixing said composition in a rotatable drum having a mixing chamber with a restricted port open to atmosphere while rotating said drum and simulaneously heating said composition by directing flame and hot gases of combustion into said drum through said restricted port, whereby the composition is directly exposed to said hot gases and hydrocarbon volatiles from the composition are burned in said drum, concurrently venting the burned hydrocarbons to atmosphere through said port, and moving said flame closer or further from said port for preventing visible unburned hydrocarbons from being vented through said port to atmosphere.

* * * * *